US006099385A

United States Patent [19]

Stock et al.

[11] Patent Number: 6,099,385

[45] Date of Patent: Aug. 8, 2000

[54] METHOD FOR REMOVING EDGE AREAS OF A LAMINATED PANEL

[75] Inventors: Lawrence J. Stock, Ann Arbor; Thomas Eric Pearson, Grosse Ile, both of Mich.

[73] Assignee: Ford Global Technologies, Inc., Dearborn, Mich.

[21] Appl. No.: 09/275,157

[22] Filed: Mar. 24, 1999

[51] Int. Cl.[7] ..... B24B 1/00

[52] U.S. Cl. ..... 451/8; 451/41; 451/43; 451/44; 451/260

[58] Field of Search ..... 451/41, 43, 44, 451/124, 130, 150, 182, 260, 8

[56] References Cited

U.S. PATENT DOCUMENTS

| | | | |
|---|---|---|---|
| 4,115,956 | 9/1978 | Huffman . | |
| 4,383,393 | 5/1983 | Takubo . | |
| 4,406,091 | 9/1983 | Eckardt et al. | 451/44 X |
| 4,423,569 | 1/1984 | Stern et al. . | |
| 4,485,594 | 12/1984 | Guertin et al. . | |
| 4,575,970 | 3/1986 | Kozai et al. | 451/182 X |
| 4,587,764 | 5/1986 | Leone et al. . | |
| 4,633,408 | 12/1986 | Reinmold et al. | 451/44 X |
| 4,667,443 | 5/1987 | Sakurai et al. | 451/44 X |
| 4,667,444 | 5/1987 | Langlois et al. | 451/44 X |
| 4,739,590 | 4/1988 | Myers et al. | 451/44 |
| 4,773,187 | 9/1988 | Ohta et al. . | |
| 5,146,715 | 9/1992 | Bando | 451/44 X |
| 5,197,229 | 3/1993 | Kanamaru et al. . | |
| 5,713,784 | 2/1998 | Miller | 451/44 X |
| 5,924,911 | 7/1999 | Bralander | 451/65 X |

FOREIGN PATENT DOCUMENTS

0847834A1 12/1997 United Kingdom .

*Primary Examiner*—David A. Scherbel
*Assistant Examiner*—Anthony Ojini
*Attorney, Agent, or Firm*—Damian Porcari

[57] ABSTRACT

The protruding edge of a plastic sheet in a laminated safety glass panel can be removed, or trimmed, by moving the panel edgewise over a rotating grinding wheel, such that fragments generated by the wheel are directed away from the feed path of the panel. The grinding wheel is resiliently supported by an air cylinder that maintains a desired contact pressure between the edge surface of the wheel and the protruding edge of the plastic sheet.

6 Claims, 3 Drawing Sheets

METHOD FOR REMOVING EDGE AREAS OF A LAMINATED PANEL

BACKGROUND AND SUMMARY OF THE INVENTION

This invention relates to automotive safety glass panels, and particularly to a method for removing the protruding edge area of a plastic sheet in a safety glass panel. The invention is particularly applicable to windows and windshields used in automotive vehicles. The term "windows" is used herein to collectively refer to windshields, side windows and rear windows in automotive vehicles.

In the manufacture of safety glass panels for the windows in automotive vehicles, it is a common practice to provide a sheet of elastomeric-plastic material between two panes of glass. The elastomeric-plastic sheet is bonded to both glass panes, so that in a crash situation the elastomeric-plastic sheet acts as a continuous substrate for restraining the class fragments against high speed separation from the sheet. Typically, the elastomeric-plastic sheet is formed of a stretchable vinyl butyl material.

In the manufacture of a laminated safety glass panel the stretchable elastomeric-plastic sheet is made slightly oversize, relative to the associated glass panes, in order to ensure that each glass pane will have its entire surface bonded to the elastomeric-plastic sheet. The oversize nature of the elastomeric-plastic sheet necessitates that peripheral edge areas of the sheet be trimmed (cut-away) prior to installation of the safety glass window in the vehicle.

In the past, the protruding edge area of the elastomeric-plastic sheet has been trimmed off (cut-away) manually, using a razor blade. Such a procedure is objectionable in that the process is time-consuming. Also, the process can produce stress-riser nicks in the edges of the glass panes. Also, there is some danger that the human technician will be cut at some time during the process.

Recently, there has been introduced a robotic machine for removing the protruding edge area of the plastic sheet by the mechanical slicing action of a razor blade supported on a mechanical arm that is adapted to traverse the edge area of a safety glass panel. The robotic mechanism speeds up the process, and reduces the risk of human injury. However, the razor blades must be replaced frequently, and the edge formed by the razor blade is somewhat jagged.

The present invention relates to a method for removing the protruding edge area of an elastomeric-plastic sheet in a safety glass panel, wherein a rotary grinding wheel is employed as the cutting instrumentality. The grinding wheel has the advantage that a relatively smooth regular edge is formed on the plastic sheet, in a single pass of the cutting machine. Preferably the method is performed with a robotic manipulator that is programmed to produce a relatively constant pressure of the wheel on the edge of the plastic sheet during the entire traverse of the safety glass panel across the grinding wheel.

The wheel is oriented to the panel so that the wheel rotates in a plane transverse to the plane of the safety glass panel, whereby fragments of elastomeric-plastic material are directed away from the panel so as not to clog the pores of the grinding wheel, or otherwise interfere with the grinding operation.

Further features of the invention will be apparent from the attached drawings and description of an apparatus that can be used in practice of the invention.

BRIEF DESCRIPTION OF THE INVENTION

DESCRIPTION OF A PREFERRED APPARATUS FOR PERFORMING THE INVENTION

Figure 2:
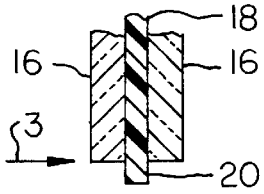
FIG. 2 is a fragmentary enlarged sectional view taken on line 2—2 of FIG. 1.
Figure 1:
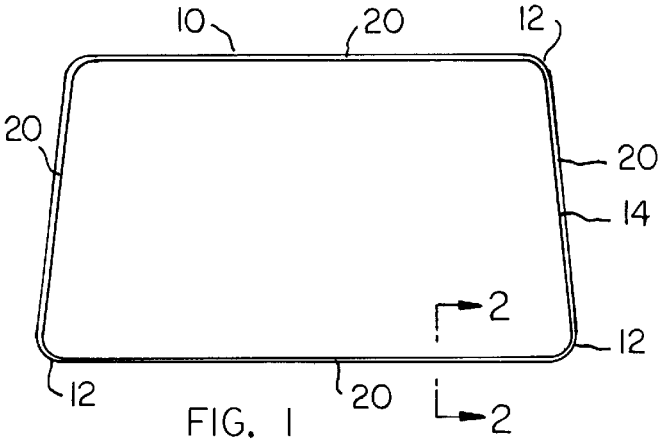
FIG. 1 is a plan view of an automotive safety glass panel that can be treated by the method of the present invention.

Referring to FIGS. 1 and 2, there is shown an automotive window safety glass panel 10 having four relatively straight or moderately curved edge areas joined together by four convex curved corner areas 12, so as to provide a continuous peripheral edge 14. The safety glass panel is a laminated transparent structure comprised of two glass panes 16 and intermediate sheet 18. The sheet is a stretchable elastomeric-plastic material that can be a vinyl-butyl copolymer having a tough coherent rubberlike character suitable for bonding tightly to the glass panes. As shown in FIG. 2, the plastic sheet protrudes beyond the glass panels to provide a protruding edge area 20 along the entire periphery of the safety glass panel.

Figure 3:
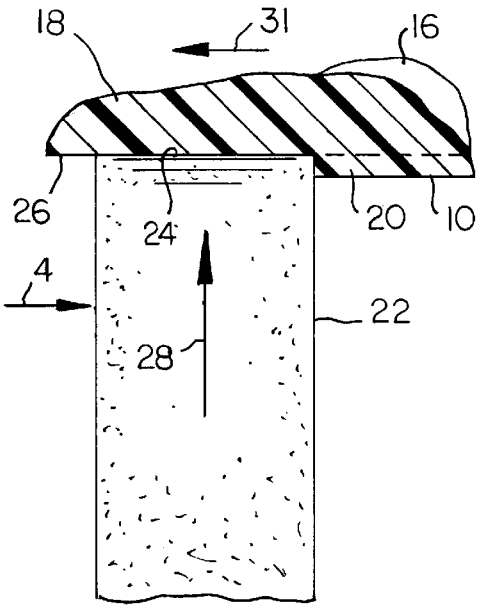
FIG. 3 is a fragmentary view taken in the direction of arrow 3 in FIG. 2, showing a grinding wheel for removing the protruding edge of an elastomeric-plastic sheet used in the safety glass panel.

The present invention is concerned with a method for expeditiously and quickly removing the protruding edge area 20 of the elastomeric-plastic sheet without cutting or nicking edge areas of glass panes 16. As shown fragmentarily in FIG. 3, the cutting instrumentality is a grinding wheel 22 having a flat peripheral edge 24 adapted to grind off protruding edge areas 20 so as to form a sheet edge surface 26 substantially flush with the edges of glass panes 16. The grinding wheel is oriented to the safety glass panel so that its rotational plane 28 is transverse to the feed direction 31 of the safety glass panel.

The rotating grinding wheel 22 is maintained in a relatively stationary position while the safety glass panel 10 is manipulated so that the entire peripheral edge of sheet 18 is moved transversely across the flat edge of wheel 20, whereby the entire peripheral edge of sheet 18 is made flush with the edges of glass panes 16. Preferably the safety glass panel is moved and manipulated by a programmed robotic manipulator of the type depicted generally in FIGS. 6 and 7. The robotic manipulator can be a commercially available construction used in the automotive industry for such operations as robotic welding and parts manipulation. A software program incorporated into the robot microprocessor keeps the edge of panel 10 in contact with the grinding wheel as the panel is moved and manipulated. The process of removing the protruding edge area of sheet 18 to achieve the flush edge 26 is preferably accomplished in a single pass of panel 10 transversely across the grinding wheel.

Figure 5:
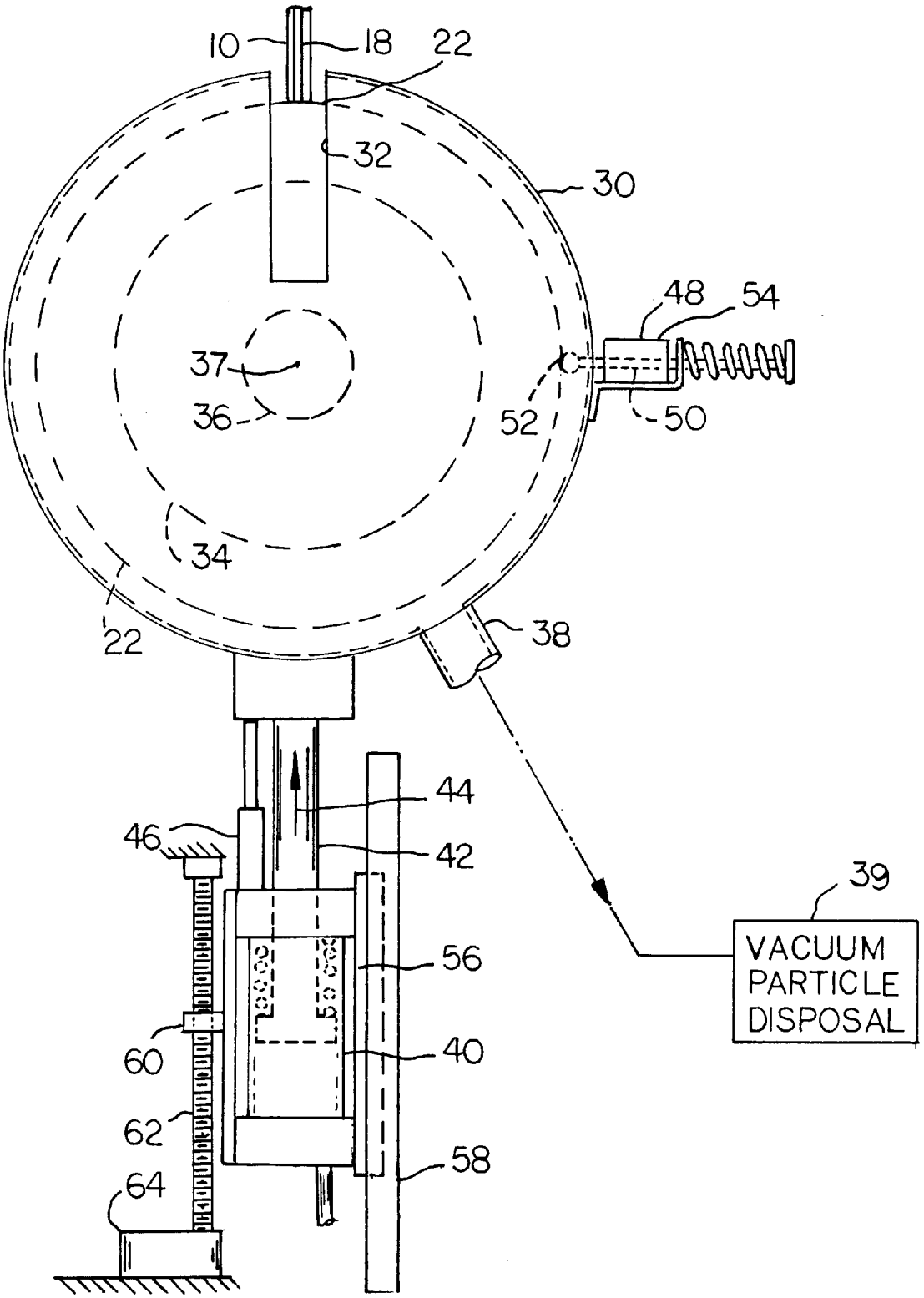
FIG. 5 is an elevational view of a grinding wheel support mechanism that can be used in practice of the invention to achieve a satisfactory removal of the protruding edge area of a plastic sheet embodied in a safety glass panel.

Grinding wheel 22 is preferably enclosed in a shroud 30 having a slot 32 for passage of the safety glass panel 10 across the edge of the grinding wheel. FIG. 5 shows the grinding wheel 22 enclosed completely within the shroud.

Figure 4:
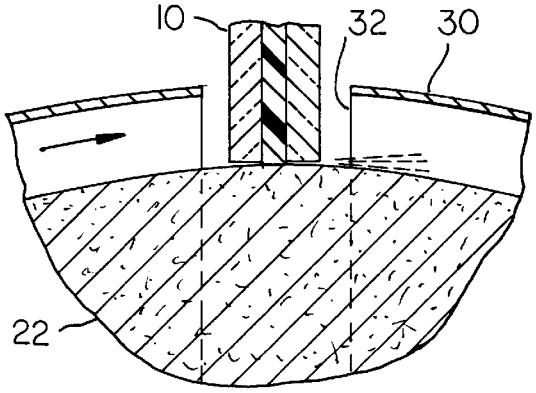
FIG. 4 is a fragmentary sectional view taken through the FIG. 3 grinding wheel, in the direction of arrow 4 in FIG. 3.

An electric motor 34, mounted on the shroud side wall, has a drive shaft 36 connected to the grinding wheel, whereby the wheel is powered for rotary motion around the shaft axis 37. Shroud 30 has a duct 38 connected to a vacuum source 39, whereby elastomeric-plastic fragments generated by the grinding wheel are captured by the shroud and pneumatically conveyed to a disposal area (e.g. a bin or bag). FIG. 4 shows the plastic fragments being directed from the grinding wheel away from panel 10 into shroud 30. The vacuum condition within the shroud continuously removes the fragments from the wheel. The fragments are directed away from the feed path 31 taken by panel 10, such that the fragments are precluded from clogging the pores of the wheel. Wear rate across the edge of the grinding wheel does not adversely affect the trimming operation.

Grinding wheel 22 is preferably a non-metallic, porous wheel formed of non-woven fibrous strands cemented together, to form a coarse wheel surface having minimal tendency to become clogged with the rubbery particles ground off sheet 18.

During the grinding operation it is necessary that wheel edge surface 24 continuously remain in pressure contact with the protruding edge of elastomeric-plastic sheet 18. An air cylinder 40 (Fig. 5) is provided for maintaining the desired contact pressure. As shown in FIG. 5, shroud 30 is mounted on the piston rod 42 of air cylinder 40, such that the introduction of pressurized air into the lower end of cylinder 40 causes shrouwd 30 to be moved upwardly, as indicated by arrow 44 in FIG. 5. The magnitude of the air pressure supplied to cylinder 40 determines the contact pressure between the edge of grinding wheel 22 and the plastic sheet 18. In an alternate arrangement, a servo motor can be used with a rack pinion system to maintain the desired pressure.

To maintain a suitable control on the wheel 22-sheet 18 contact pressure, the air pressure supplied to cylinder 40 can be varied by a pressure feed-back sensor 46 trained between the cylinder and shroud 30. Sensor 46 can include a strain gage having an electrical output that increases the air pressure supplied to cylinder 40 when the sensed pressure falls below a desired value, or range; conversely, when the sensed pressure increases above the desired value, or range, the sensor electrical output causes the air pressure supplied to cylinder 40 to be decreased. The air pressure can be controlled by a motor-operated valve controlled by the sensor 46 signal.

Cylinder 40 has a line of action extending through the grinding wheel axis 37 in the general plane of safety glass panel 10, as depicted in FIG. 5. Sensor 46 is oriented to sense pressure variations in a direction parallel to the line of action of cylinder 40.

Optimum grinding action is achieved when the edge surface of wheel 22 is moving at or near a particular linear speed transversely across the protruding edge of sheet 18. As the grinding wheel 22 wears down to a smaller diameter, the edge surface 24 will progressively slow down in accordance with the reduced wheel diameter (assuming no change in the rotational speed of motor 34 and the wheel). Alternatively, the rotational speed of the wheel will be reduced to maintain optimal removal rates.

Therefore, it is desirable to include in the system a mechanism for varying the rotational speed of the grinding wheel so as to maintain a relatively constant edge surface 24 speed, in spite of variations in grinding wheel diameter due to wear. FIG. 5 shows a probe or sensor 45 for measuring or sensing variations in grinding wheel diameter. Sensor 48 can comprise a slidable rod element 50 having a roller 52 in contact with the wheel 22 edge surface, and a linear variable displacement transformer 54 responsive to rod 50 motion to generate an electrical signal proportionate to changes in grinding wheel diameter. The electrical signal can be used in a motor control circuit to change the speed of motor 34, whereby the edge of the grinding wheel moves in a desired speed range, in spite of variations in wheel 22 diameter due to wear.

Changes in grinding wheel diameter can affect the relation between sensor 46 and shroud 30 necessary to produce a desired contact pressure between wheel 34 and sheet 18. Therefore cylinder 40 is slidably adjustable to maintain a desired relation between sensor 46 and the shroud, as the wheel diameter becomes smaller. As shown in FIG. 5, air cylinder 40 is secured to a slide 56 that is slidable mounted on a fixed track 58. The air cylinder carries a nut 60 that is in mesh with a rotary screw 62 operated by a servo motor 64. The electrical signal generated by sensor 48 can be used to operate motor 64, whereby a desired relation can be maintained between sensor 46 and shroud 30.

Figure 6:
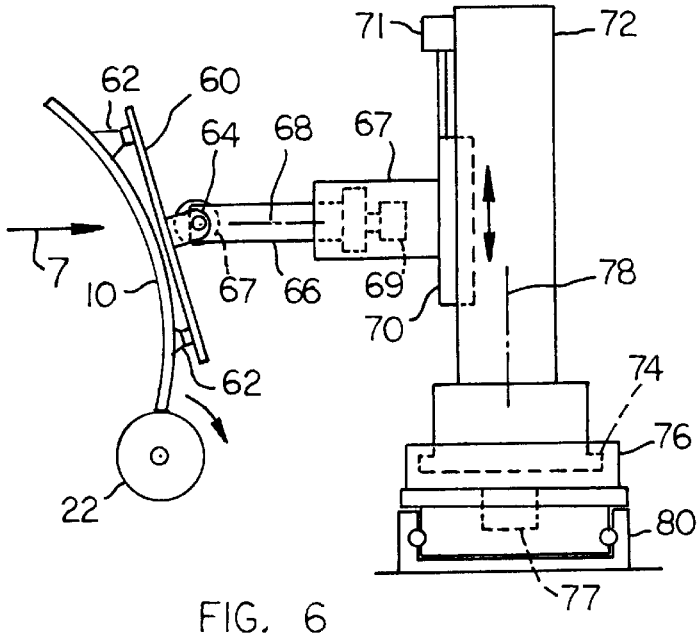
FIG. 6 is an elevational view of a programmable robotic manipulator that can be employed in conjunction with the FIG. 5 grinding wheel system, in practice of the invention.
Figure 7:
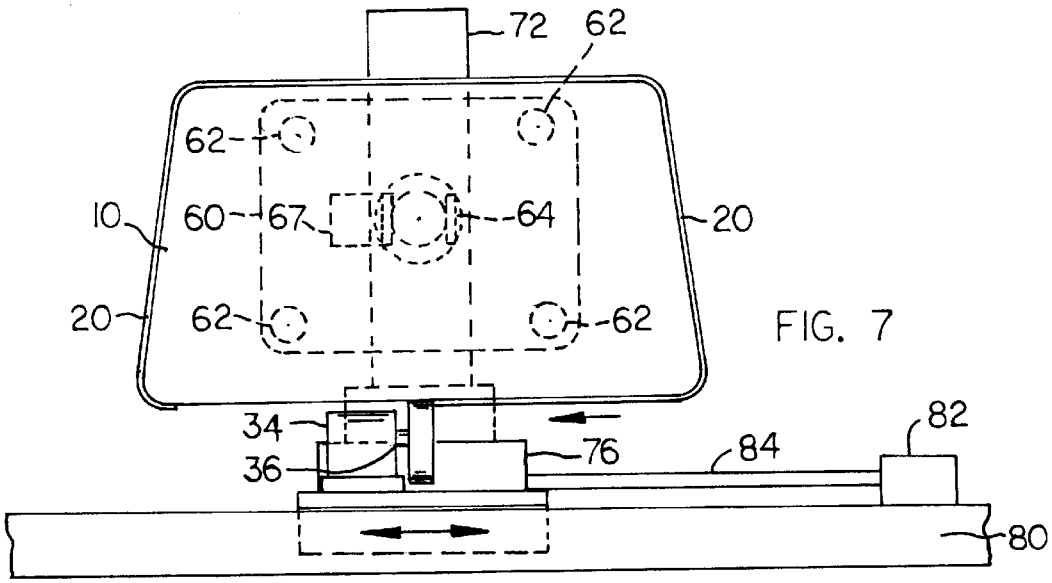
FIG. 7 is an elevational view taken in the direction of arrow 7 in FIG. 6.

As previously noted, the safety glass panel 10 is preferably supported by a robotic manipulator while it is being fed transversely across the edge of grinding wheel 22. FIGS. 6 and 7 schematically illustrate some features of a robotic manipulator that can be used to move and manipulate the safety glass panel.

The illustrated robotic manipulator comprises a carrier plate 60 having plural suction cups 62 adapted to grip one face of safety glass panel 10. Ears 64 on plate 60 rotatably mount to the end of a horizontal arm 66; a servo motor 67 powers carrier plate 60 around the ear 64 rotational axis.

Arm 66 has a swivel fit in support structure 67, whereby arm 66 is rotatable around arm axis 68; a servo motor 69 in structure 67 can be used to rotate arm 66 around axis 68. Structure 67 is attached to a slide plate 70 that can move vertically along an upstanding post structure 72. Motor 71 powers structure 67 for vertical motion.

Post structure 72 has a circular base 74 that has a rotary fit in a table 76; an electric motor 77 in the table powers post structure 72 for rotary motion around vertical axis 78. Table 76 is slidable horizontally in a fixed track structure 80; an electrical motor 82 powers a rotary screw 84, for moving table 76 back and forth along track structure 80.

A software program installed in the controller for the robotic manipulator can be used to operate the various motors 67, 69, 71, 77 and 82, whereby the manipulator can move and manipulate safety glass panel 10 through the necessary motions to bring the entire protruding edge 20 of sheet 18 into contact with the grinding wheel 22. Air cylinder 40 maintains the rotating wheel in pressure contact with protruding edge 20 while panel 10 is being manipulated. As previously noted, the edge of the plastic sheet 18 in the safety glass panel is trimmed flush with the associated panes in a single pass of the panel across the grinding wheel. Although the description refers to a glass pane, the pane can be formed of other materials, e.g. transparent plastic.

What is claimed:

1. A method of removing a protruding edge of an elastomeric-plastic lamination in an automotive window safety panel, wherein said lamination is sandwiched between two glass panes to form the safety panel; comprising the steps of:

a.) orienting the safety panel to a grinding wheel that has a rotational plane and a peripheral cutting edge normal to said rotational plane, said orienting step being carried out so that the plane of the safety panel is normal to the rotational plane of the grinding wheel;

b.) rotating the grinding wheel;

c.) passing the safety panel transversely across the edge of the grinding wheel, while maintaining the plane of the panel normal to the rotational plane of the grinding wheel, so that the protruding edge of the elastomeric-plastic lamination is removed from the panel by the cutting action of the wheel edge without affecting the two glass panes; and d.) resiliently biasing the grinding wheel toward the safety panel while the panel is passing transversely across the edge of the wheel, so that the wheel has continuous pressure contact with the protruding edge of the elastomeric-plastic lamination.

2. The method of claim 1, wherein the biasing step is carried out by varying the air pressure supplied to a fluid cylinder that operatively supports the grinding wheel.

3. The method of claim 1, wherein the biasing step further comprises the step of sensing the pressure of the grinding wheel on the edge of the elastomeric-plastic lamination, and employing the sensed contact pressure to control the air pressure supplied to the fluid cylinder.

4. The method of claim 1, wherein the biasing step is carried out so that there is a substantially constant pressure between the grinding wheel and the edge of the elastomeric-plastic lamination while the safety panel is passing transversely across the edge of the wheel.

5. The method of claim 1, and further comprising the step of: (e) disposing said grinding wheel in a vacuum chamber, so that plastic fragments generated by the grinding wheel are captured in the vacuum chamber.

6. The method of claim 1, and further comprising the steps of sensing the variations in the diameter of the grinding wheel due to wear, and using the sensed wheel diameter variations to regulate the rotational velocity of the grinding wheel so as to maintain a relatively constant wheel edge speed in spite of variations in the grinding wheel diameter.

* * * * *